United States Patent [19]

Kulesza

[11] Patent Number: 5,069,460

[45] Date of Patent: Dec. 3, 1991

[54] POCKET SIZED MECHANICAL GAME

[76] Inventor: Ralph J. Kulesza, 4928 S. Kilpatrick, Chicago, Ill. 60305

[21] Appl. No.: 629,649

[22] Filed: Dec. 7, 1990

[51] Int. Cl.[5] ..... A63F 7/06

[52] U.S. Cl. ..... 273/355; 273/87.2; 273/90; 273/94; 273/352; 273/405; 273/85 R

[58] Field of Search ..... 273/352, 85 R, 87.2, 273/87.4, 88, 90, 91, 94, 355, 354, 367, 368, 369, 370, 405

[56] References Cited

U.S. PATENT DOCUMENTS

| | | | |
|---|---|---|---|
| 1,493,934 | 5/1924 | Grau et al. | 273/87.2 |
| 1,819,932 | 8/1931 | Walden | 273/85 R |
| 2,173,865 | 9/1939 | Swenson | 273/352 X |
| 2,232,743 | 2/1941 | Swenson | 273/368 |
| 3,899,173 | 8/1975 | Zaris | 273/405 |
| 4,826,176 | 5/1989 | Kobayashi | 273/355 X |
| 4,872,679 | 10/1989 | Bohaski et al. | 273/94 X |

*Primary Examiner*—William H. Grieb

[57] ABSTRACT

A hand held game that utilizes a small motor mechanism to uniquely animate various targets, targets, goals or projectile path to increase the challenge of putting an object through the goal or contacting the object with a target at a particular time. Possible game arrangements include: a soccer game with a moving goalie; a basketball game with a rotating hoop; a football game with a rotating goal post; a baseball game with a rotating disc scoreboard; a golf game with a rotating green; and a skee-ball game with an oscillating ramp. A small wind-up motor animates all of the targets, goals or paths.

31 Claims, 4 Drawing Sheets

5069460
Fig. 1
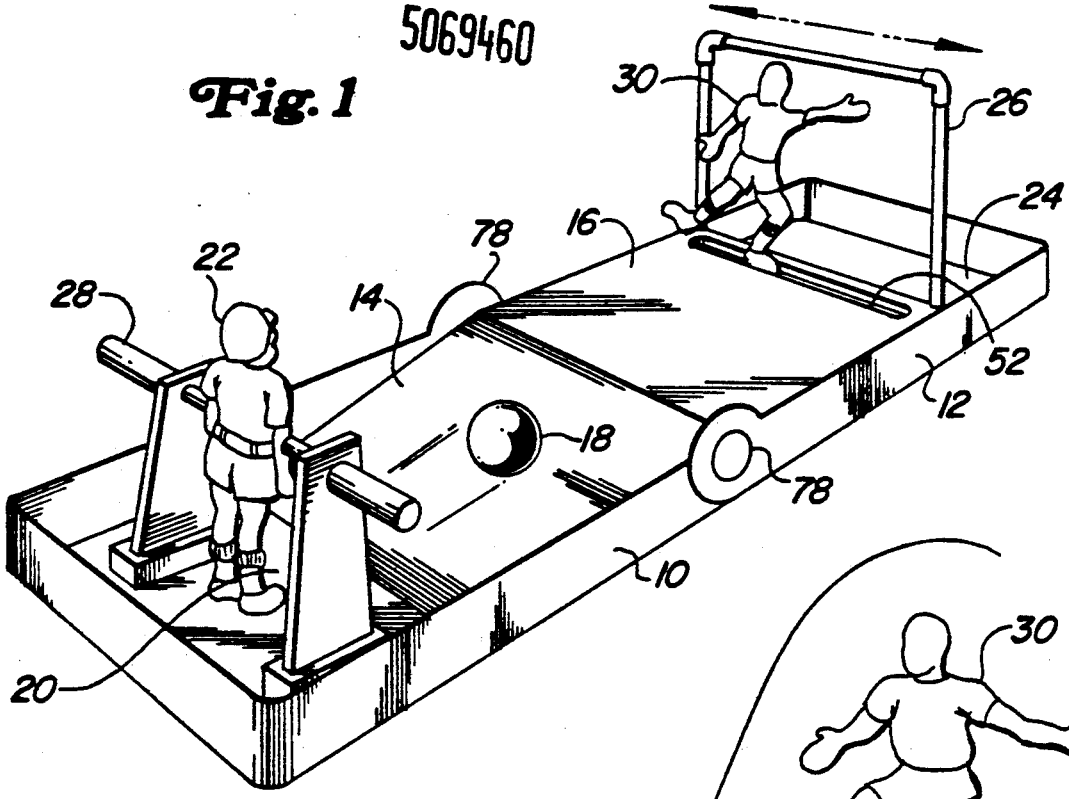
Fig. 2
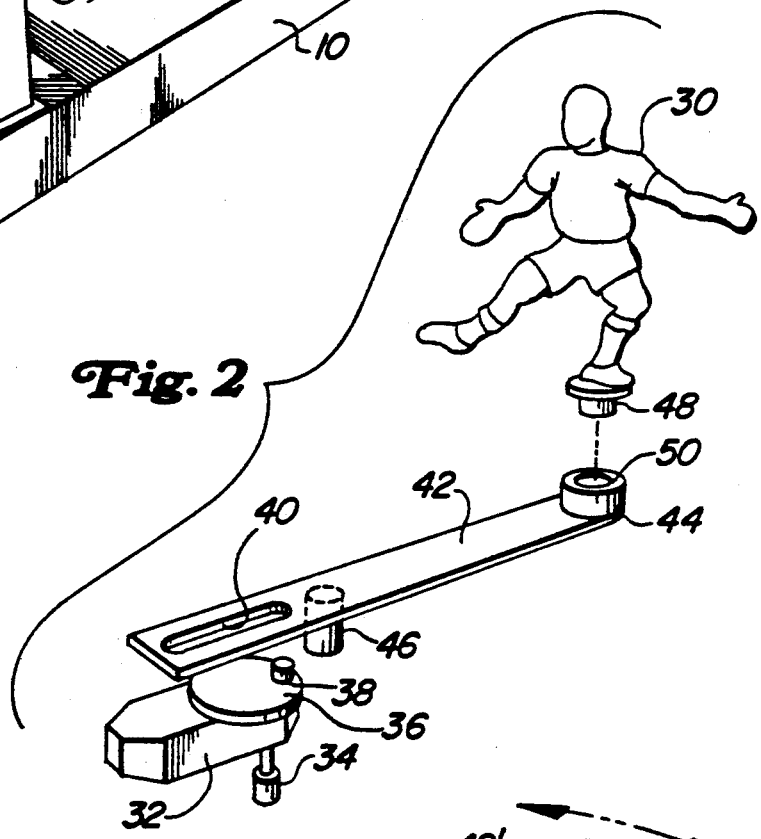
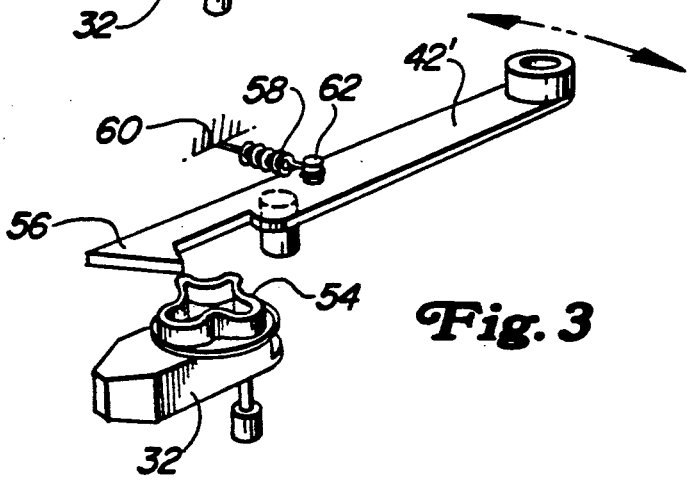
Fig. 3

Fig. 6
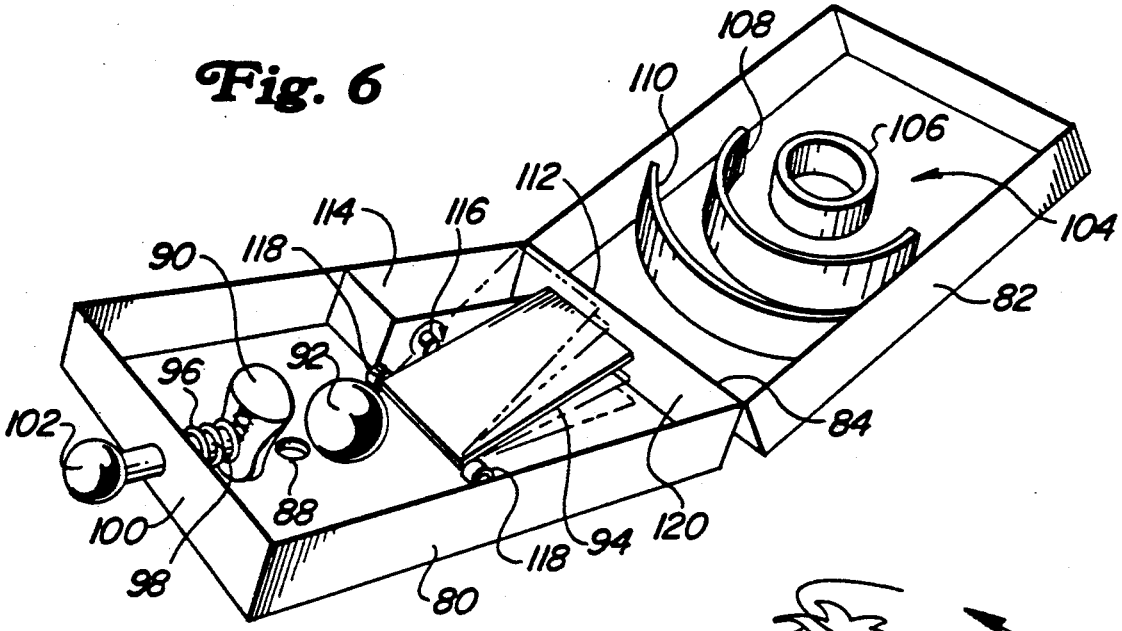
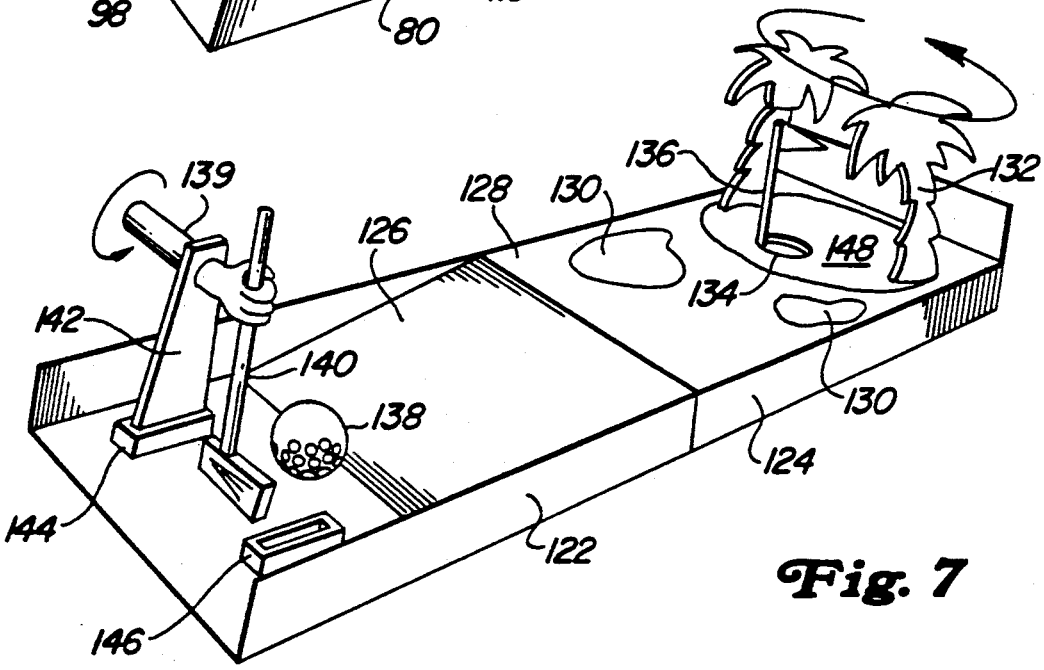
Fig. 7
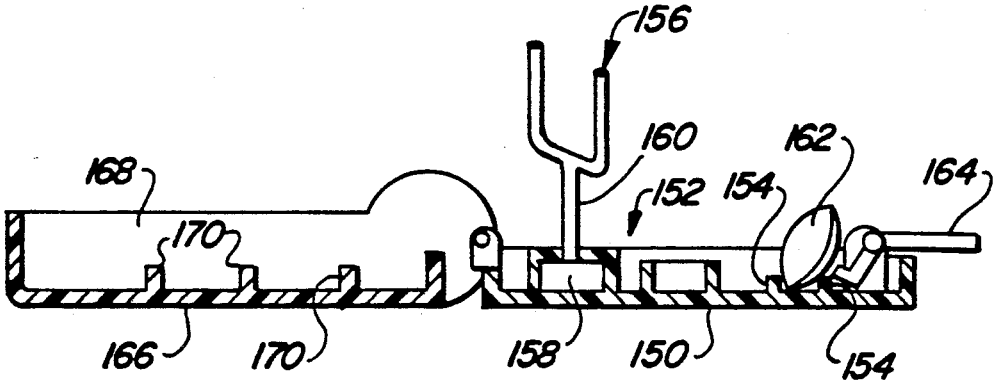
Fig. 8

POCKET SIZED MECHANICAL GAME

BACKGROUND OF THE INVENTION

1. Field of the Invention

This invention relates generally to the field of action games and more specifically to mechanical action games that can be carried in a person's pocket.

2. Description of the Prior Art

A number of games have a size that will permit them to be carried around in a pocket. Such games vary in type from pocket chess sets to hand held pin ball games. Recently electronic games with LCD displays have taken over a large portion of the market for pocket sized games.

It is a general object of this invention to provide a mechanically operated pocket sized game that provides a similar challenge to the electronic games.

A more specific object of this invention is to provide a pocket sized game having mechanical elements that interact with the actions of the player to provide a challenge in the play of the game.

BRIEF SUMMARY OF THE INVENTION

This invention is the first game pocket sized game that uses a motor to create a challenge in the aiming or release of projectiles at a target. The game consists of a pocket sized container that folds out into a playing surface. The container also houses a small motor. A player of the game shoots a projectile from a starting point over or above the game surface toward a target at the end of the playing surface. As the player shoots, the motor moves an element of the game to make the player miss the target or vary the points for hitting the target at a particular time. Thus, the motor may move an obstacle located between the starting point and the target, the target itself, or a indicator that gives a score when the target is hit. Many different types of games can fit into the pocket sized format and employ the small motor to make the timed release of the projectile an important part of the game. Game arrangements can depict baseball, hockey, football, soccer, basketball, hockey golf, skee-ball, etc. Design of the game permits handy storage of all of its elements in the container.

Accordingly in a broad embodiment, this invention is a A pocket size game device comprising a playing surface, a projectile, a target, means for shooting the projectile from a starting point toward the target at a time controlled by a player and a motorized means for varying the effect of shooting the projectile toward said target over time.

In a another embodiment this invention is a pocket size game device. The device includes two game sections each game section defining a game surface and the game sections having an open position wherein the game sections are exposed and a closed position wherein the game sections are stacked together to form an interior compartment and the game surfaces are inside the compartment. One or more of the game sections defines a playing surface and a target on for shooting the projectile travels across the playing surface from a starting point on one of said game surfaces toward the target. The means for shooting allows a player to control the timing for release of the projectile. At least one obstacle stands between the starting point and the target. A motorized means changes the position of the obstacle.

In another aspect of this invention the obstacle between the starting point and the target is replaced with an indicator associated with the target for recording a score when the projectile contacts the target and a motorized means is provided for rotating the indicator.

Other objects, embodiments and details of this invention are described in the following detailed description of this invention.

BRIEF DESCRIPTION OF THE DRAWINGS

FIG. 1 is an isometric view of the game of this invention showing a soccer version of the game with the device in an open position.

FIG. 2 is a perspective view of a motor mechanism for the game removed from the device of FIG. 1.

FIG. 3 depicts a modified motor mechanism similar to that shown in FIG. 2.

FIG. 6 is an isometric view showing a skee-ball version of the game of this invention.

FIG. 7 is an isometric view showing a golf version of the game of this invention.

FIG. 8 is an elevation view showing a football version of the game of this invention.

DETAILED DESCRIPTION OF THE INVENTION

Figure 4:
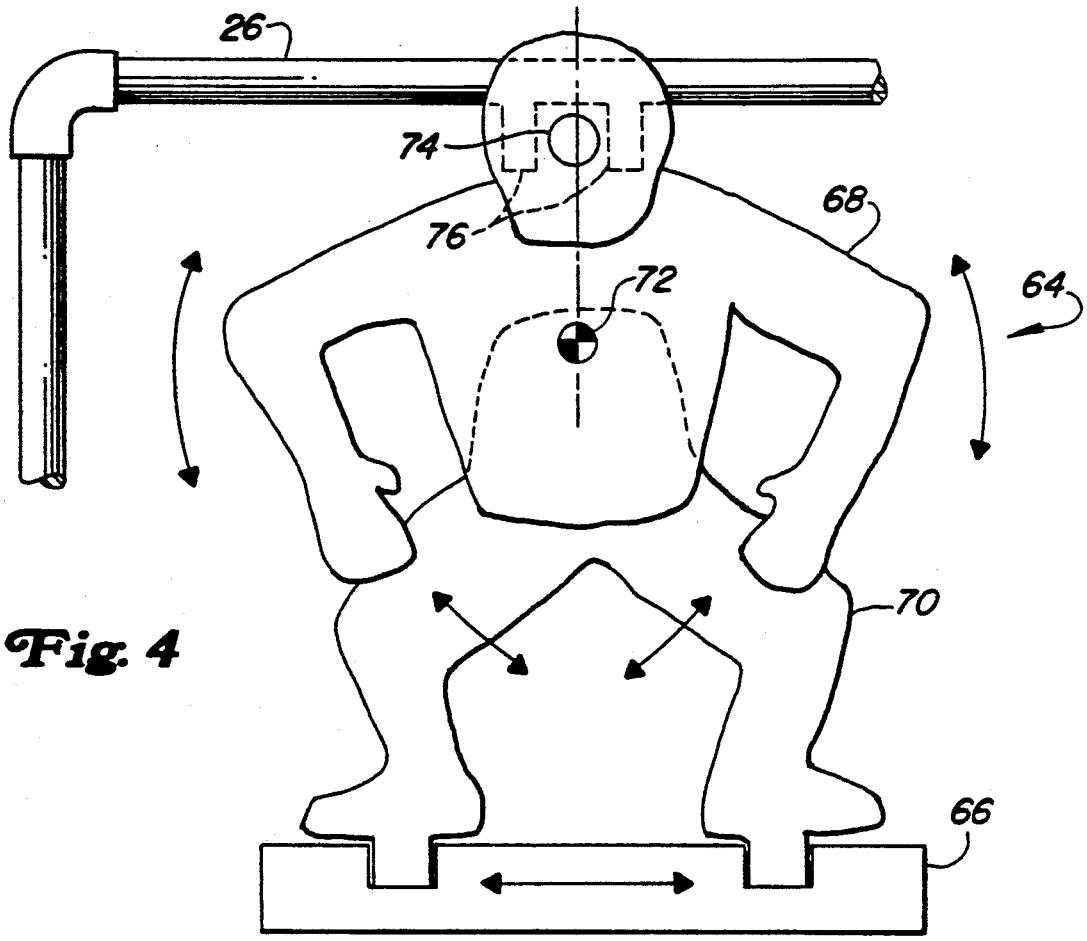
FIG. 4 is an alternate arrangement for an obstacle of the game of FIG. 1.

The game of this invention can be presented in a variety of different formats. As depicted in FIG. 1 the format presents a simulated soccer game. FIG. 1 presents a number of elements that are common to all versions of the game. Each game has two or more game sections 10 and 12 that define game sections 14 and 16. A projectile, in the form of ball 18 travels across a playing surface comprising game surfaces 14 and 16 from a starting point 20. A soccer FIG. 22 provides a means for shooting the ball 18 across the playing surface toward a target formed by pocket 24 behind a goal opening 26. A player of the game shoots the ball by sharply turning a shaft 28 at a desired time. A motorized element moves an obstacle in the form of a goalie FIG. 30 that obstructs the path between the starting point 20 and the target 24. As a motor (not shown) moves FIG. 30 back and forth the player must time his shot to avoid the figure. Movement of some part of the device by a small motor is a common element in every version of the device of this invention and introduces the need for timing in the play of the game.

Movement of some element of the game can be generated by any type of small motor. A small electric motor will provide suitable movement of a variety of game elements. However, for simplicity and cost savings a small wind-up type motor is preferred for use in all versions of these games.

FIG. 2 shows the mechanized part of the game removed from the game section 12. The mechanism includes a self-contained wind-up motor unit 32 having a downward projecting winding stem 34 and an upper output shaft (not shown) having a disc 36 located thereon. Winding stem can be designed to project from any surface of the game, but will preferably not project from the playing surface. An eccentric pin 38 projects upwardly from the disc and engages a slot 40 defined by an ar 42. As disc 36 turns pin 38 reciprocates in slot 40 and imparts a swinging motion to end 44 of arm 42 as it pivots about a shaft 46. A socket 50 at end 44 receives a plug 48 located at the end of FIG. 30 to fix FIG. 30 to the end of the shaft. Referring to to FIG. 1 the plug 49 together with the arm 42 and the motor 32 are located below game surface 16 so that the FIG. 30 extends above the game surface through a slot 52.

Motor 32 can move the figure in a regular or irregular cycle. The eccentric disc and slot arrangement of FIG. 2 will swing the figure from side to side in a regular cycle. FIG. 3 shows the replacement of the disc 36 with a cam 54 and the slot 40 with a follower 56 at the end of an arm 42'. A spring 58 secured at one end to the game section and at its other end to arm 42" by a pin 62 keeps the follower against the cam 54. The cam and follower arrangement impel the figure across the game surface in an irregular cycle.

Those skilled in the art can envision a many different ways in which action can be imparted to the game. For example FIG. 4 illustrates a modification to the soccer figure that introduces additional motion. A carriage 66 retains a player 64 having a torso section 68 and a leg section 70 that plugs into carriage 66. A motor mechanism reciprocates carriage 66 in a manner similar to that previously described. A pin 72 joins the torso and leg sections of FIG. 64. A pair of prongs 76 depending from the top bar of goal 26 engage a pin 74 located at the head of the figure. As carriage 66 reciprocates, lateral movement of pin 72 relative to pin 74 causes the torso 68 to sway sideways. If desired the arms of FIG. 68 can extend outwardly to increase the difficulty of shooting the ball past the goalie.

Figure 5:
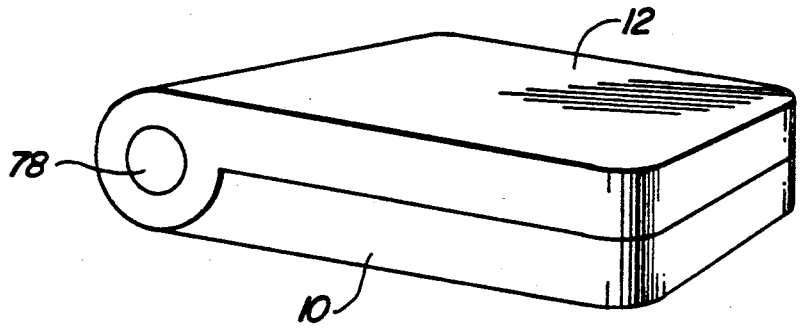
FIG. 5 shows the game of FIG. 1 in a closed position.

When not in use the game packs up neatly and game sections 10 and 12 form a pocket sized carrying case as shown in FIG. 5. The game sections 10 and 12 form the carrying case. Both game section are brought together with the game surfaces 14 and 16 facing each other. A suitable clasp (not shown) holds the game section together to form a compartment that houses both game surfaces. Preferably the game sections fold together along a hinge 78. Many parts of the game that project above game surfaces 14 and 16 are received by depressions on the opposing game surface as the sections are brought together. Tall parts of the game, such as the goal 26 and FIGS. 22 and 30 are disassembled from the game surface and space is provided in the compartment for storage of these parts.

FIG. 1 shows the game with only two game sections 10 and 12. However, the game may use any amount of game sections. The only limitations on the number of game sections is that they can be stacked together into a pocket sized container and they can be joined together to form the game surface when the game is in use.

Preferably the game will use two rectangular game sections. In the preferred form of this invention a hinge portion 78 joins the short sides of game sections 10 and 12. The game sections open by folding the game section apart about hinge 78 and close by folding the game sections together about hinge 78. Hinge 78 can permit any desired degree of rotation. In the game of FIG. 1 the hinge permits 180 degrees rotation so the game surfaces together form a single level playing surface. In other versions of the game the degree of rotation about the hinge can be limited to maintain one game surface at an angle with respect to the other game surface.

FIG. 6 pictures a skee-ball version of the pocket sized game. The game includes a hinge section 84 that joins game sections 80 and 82. Section 80 contains a playing surface 86 having a starting point 88 from which a striker in the form of a stylized foot 90 propels a projectile in the form of a ball 92 toward a ramp 94. A spring 96 positioned around a shaft 98 acts between the foot and an end wall 100 of the game section 80 when a player compresses spring 98 by grasping end ball 102 and pulling shaft 96 outwardly. When the player releases end ball 102 foot 98 strikes ball 92 and shoots it against ramp 94 which launches ball 92 upwardly into game section 82. Game section 82 defines a playing surface 104 with a target provided by a number of partitions for receiving ball 92 in different zones. Hinge 84 limits relative rotation of sections 82 and 80 and so that when opened, the game positions section 82 at a slight incline relative to section 80. After landing in section 82 the angle causes the ball to continue rolling until it rests in circular partition 106, semi-circular partitions 108 and 110 or against side 112 of game section 82. The object of the game is to get ball 92 in the smallest partition and the player receives the highest score when the ball lands in the partition 106 and lower scores as the ball lands in lower partitions.

In contrast to the vertically extending obstacle of the soccer game the skee-ball game of FIG. 6 uses ramp 94 as a obstacle that changes the path between the starting point and the target. A motor housed in a closed compartment 114 continuously changes the inclination of ramp 94. The motor (not shown) rotates a crank 116 which lifts and lowers the center of the ramp. Pivotal attachment points 118 hold the forward end of ramp 94 against the playing surface 86 while the free end of crank 116 swings the free end of the ramp up and down.

The swinging ramp and the variable spring pressure of the striker give the player two variables to control when trying to shoot ball 92 into the target. The trajectory of the ball will vary with the force of the spring and the angle of the ramp when impacted by the ball. Thus, depending on the spring force applied and the timing of its release ball 92 can end up resting against any of the previously described partitions or may not clear the end wall 120 of game section 80.

In addition to placing an obstacle between the starting point and the target other versions of the game move the target itself. FIG. 7 shows a simulated golf game comprising game sections 122 and 124 that unfold to provide playing surfaces 126 and 128. The game section present a fairway and green for a golf hole complete with traps 130, palm tree hazards 132 and a hole 134 with pin 136. A player shoots a miniature golf ball 138 by rotating a shaft 139 that turns a golf club 140. One of two sockets 144 and 146 receive a bracket 142 that pivotally holds shaft 139. Providing the two sockets 144 or 146 allows the player to select a right or left hand shot. The difficulty of shooting the ball 138 into hole 134 is increased by a small motor (not shown) that rotates a disc 148 which holds the palm trees 132 and defines hole 134. Therefore the player must time the release and control the force of the shot to get ball 132 to hole 134 at the proper time.

Those skilled in the art can think of a number of different moving targets that can be used in other versions of this game. For instance a football version of the game could use a passer or a kicker as a launcher for attempting to send a football through a rotating goal post. A rotating hoop can provide another moving target.

FIG. 8 shows a cross-section of an elevation view of a football version of the game. In this version of the game a game section 150 defines a playing surface 152 from which a rotating goal post 156 projects upwardly. A small wind-up motor 158 rotates the goal post about its center support 160. A pair of protrusions 154 define a kicking tee for holding a miniature football 162. A kicker lever 164 launches the football toward the goal post and an opposite game section 166 which defines a playing surface 168 having a series of ribs 170 for dividing the playing surface 168 into a plurality of scoring zones. With proper timing and technique tapping of the kick lever 164 sends the football through the goal post and into one of the scoring zones.

Figure 9:
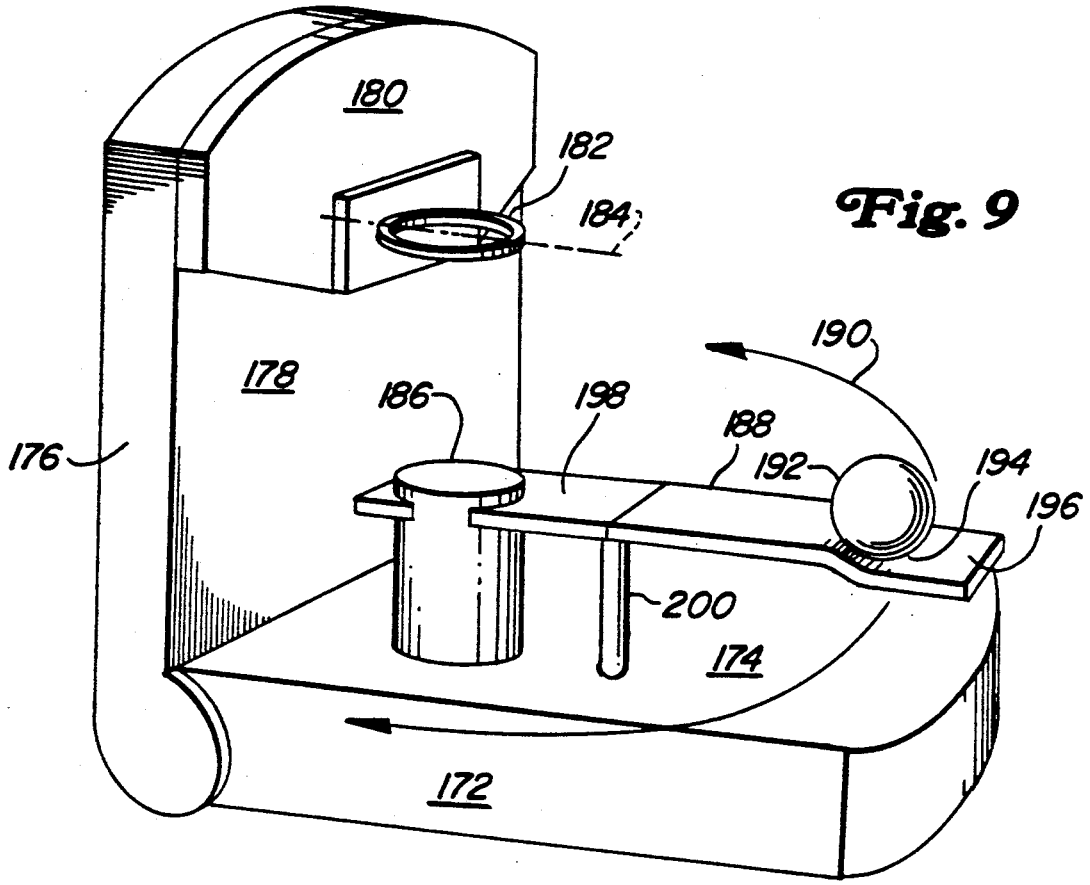
FIG. 9 is an isometric view showing a basketball version of the game of this invention.

Another variation of the game uses a basketball theme. As shown in FIG. 9, a bottom section 172 forms a game base that defines a playing surface 174 and from which another game section 176 projects perpendicularly to form a playing surface in the form of a backdrop 178. Backdrop 178 holds a miniature basketball backboard 180 having a hoop 182. A small wind-up motor (not shown) rotates hoop 182 about a transverse axis 184. Playing surface 174 rotatably holds a pivot column 86, which secures an arm thereto for movement about an arc 190. Arm 188 receives a ball 192 in a pocket 194. By depressing and releasing end 196 of arm 188 a player launches ball 192 at the hoop 182. With proper timing ball 192 will pass through hoop 182 and the player shooting the ball will score. Pivoting of arm 188 about column 186 allows a player to make angle shots. Arm 188 has a forward portion 198 that telescopes into the back portion of the arm to vary the length of the arm. Thus, the arm can be made longer to increase the difficulty of making a shot through the hoop. A post 200 at the distal end of arm portion 198 supports the arm to add rigidity to the arm and increase its spring for shooting the ball.

Figure 10:
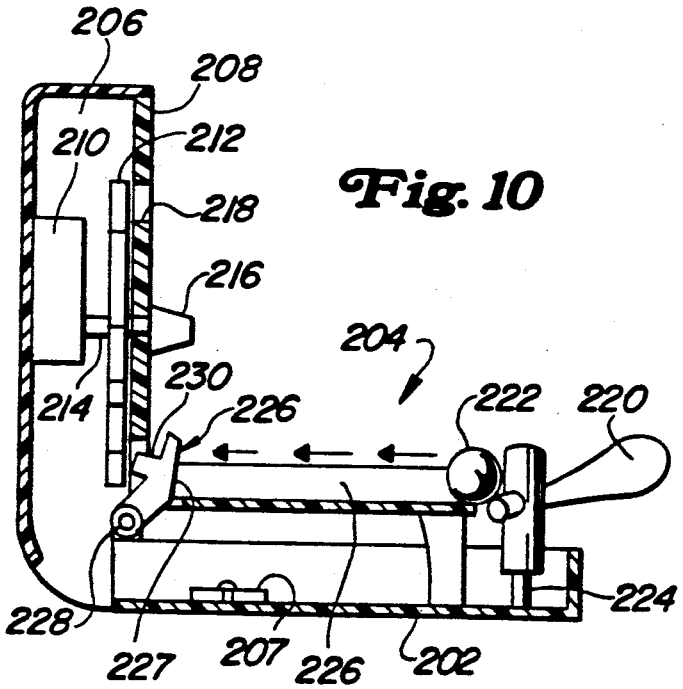
FIG. 10 is an cross section view showing a baseball version of the game of this invention.
Figure 11:
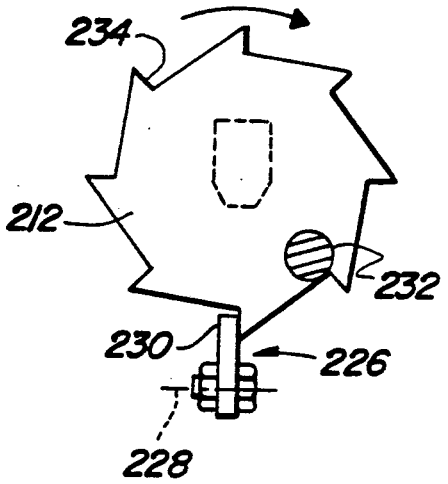
FIG. 11 is a plan view of part of the mechanism for the baseball game.

Other versions of this game vary the effect of making a shot a particular time by changing the point value o the score associated with hitting a fixed target. One such arrangement uses a baseball theme. FIG. 10 illustrates a cross-section of the baseball type game. A section 202 defines a playing surface and provides a game base from which another section 206 projects perpendicularly. One or more scoring wheels 207 for recording the score of an individual player are rotatably mounted on the playing surface 204. Section 206 provides a game surface in the form of a baseball scoreboard 208. A small wind-up motor 210 spins an indicator wheel 212 about a shaft 214 behind score board 208. The end of shaft 214 has a wind-up knob 216 that extends to the outside of the score board for winding up motor 210. An score indicator marked on the outside of the wheel will appear through one or more windows 218 in the score board when properly aligned therewith. Play of the game progresses by swinging a pivotally mounted bat 220 into contact with a miniature baseball 222. Bat 220 may be torsionally mounted on a post 224 to swing the bat by rotating it against the torsional resistance and releasing it or post 224 may provide a simple pivotal mounting for the bat. In order to facilitate the aim of ball 222 it travels along a trough 226. Trough 226 is positioned above the playing surface to simulate the ball flying through the air. At the end of the trough the ball activates a stop lever 226 by contacting a target 227 and pivoting the lever about a point 228 and moving a prong 230 into engagement with wheel 212. As shown more clearly by plan view of the wheel 212 and the stop lever 226 in FIG. 11, teeth 234 extend radially from the periphery of wheel 212 in a regular spacing. When prong 230 moves into the plan of the wheel it engages one of the teeth and stops the wheel. Once the wheel stops the previously described mark, now indicated in FIG. 11 as 232 will appear in a window of score board 208. The player records any runs scored by hitting the target by rotating wheel 207. Play resumes by pulling the stop lever 226 back from the scoreboard and the wheel 212 resumes spinning until the next hit.

The description of this invention in the context of a particular format is not meant to limit this invention to the details shown therein.

I claim:

1. A pocket sized game comprising:

a playing surface a projectile a target means for shooting said projectile from a starting point toward said target at a time controlled by a player, and motorized means for varying the effect of shooting the projectile toward said target over time, said game comprising at least two sections, each section defining a game surface and said sections cooperate to defined a closed position wherein said sections provide a compartment enclosing said game surfaces and an open position wherein said game surfaces are exposed.

2. The device of claim 1 wherein said game surfaces form a contiguous playing surface when said sections define said open position.

3. The device of claim 1 wherein said device includes two sections, each of said sections have a long dimension and a short dimension and said sections are hinged along a side normal to said long dimension.

4. The device of claim 3 wherein said sections are folded along said hinge to define said closed position.

5. The device of claim 3 wherein said hinge opens 180 degrees and both of said sections defined a playing surface.

6. The device of claim 3 wherein said hinge opens to a 90 degree angle and one game surface extends outwardly from the other of said game surfaces.

7. The device of claim 6 wherein said playing surface is located on one of said game surfaces and said target is defined by the other of said game surfaces.

8. A pocket size game device comprising:

two game sections each game section defining a game surface, said game sections having an open position wherein said game sections are exposed and a closed position wherein said game sections are stacked together to form an interior compartment and said game surfaces are inside said compartment when said game sections are in a closed position;

a playing surface defined by at least one of said game surfaces;

a projectile;

a target on one of said game surfaces;

means for shooting said projectile from a starting point on one of said game surfaces toward said target at a time controlled by said player;

at least one obstacle between said starting point and said target;

motorized means for changing the position of said obstacle over time.

9. The device of claim 8 wherein said motor moves said obstacle in an irregular motion.

10. The device of claim 8 wherein said obstacle comprises a ramp positioned along a path between said starting point and said target and said motorized means varies the angle of inclination of said ramp.

11. The device of claim 8 wherein said obstacle comprises a planar element that projects perpendicularly above said game surface.

12. The device of claim 11 wherein at least a portion of said obstacle reciprocates transversely across said playing surface.

13. The device of claim 12 wherein said planar element comprises an upper section and a lower section, the top section is fixed with respect to said game surface, the bottom of said element reciprocates with respect to said game surface and said top and bottom sections are hinged such that reciprocal movement of said bottom section imparts a pivotal movement to said upper section.

14. The device of claim 8 wherein a hinge joins said game sections and said sections are foldable about said hinge to move said game sections to said closed position and rotated apart about said hinge to move said game sections to said open position.

15. The device of claim 8 wherein said motorized means comprises a wind up spring.

16. A pocket size game device comprising:

two game sections each game section defining a game surface, said game sections having an open position wherein said game sections are exposed and a closed position wherein said game sections are stacked together to form an interior compartment and said game surfaces are inside said compartment when said game sections are in a closed position;

a playing surface defined by at least one of said game surfaces;

a projectile;

a target on one of said game surfaces having an indicator associated therewith for recording a score when said projectile contacts said target;

means for shooting said projectile from a starting point on one of said game surfaces toward said target at a time controlled by said player;

motorized means for rotating said indicator.

17. The device of claim 16 wherein said motorized means rotates said target.

18. The device of claim 17 wherein said target includes a depression for receiving said projectile and said indicator records a score when said projectile enters said depression.

19. The device of claim 16 wherein a hinge joins said game sections and said sections are foldable about said hinge to move said game sections to said closed position and rotated apart around said hinge to move said game sections to said open position.

20. The device of claim 18 wherein said game sections each provide a portion of said playing surface, a hinge joins said game sections and said sections are foldable about said hinge to move said game sections to said closed position and rotated apart by 180 degrees around said hinge to move said game sections to said open position.

21. The device of claim 19 wherein said target comprises a hoop having a diameter larger than said projectile and said motorized means rotates said hoop about a transverse axis.

22. The device of claim 21 wherein said game sections are rotated by 90 degrees about said hinge to said open position, one of said game sections forms a backdrop, said backdrop has said hoop and said hoop rotates about an axis perpendicular to said backdrop.

23. The device of claim 22 wherein said playing surface comprises a pivotal arm mounted parallel to said playing surface, said pivotal arm having a starting point in the form of a pocket that receives said projectile and said arm is made of a resilient material that acts as a spring to launch said projectile.

24. The device of claim 23 wherein said arm includes means for changing its length to vary the distance between said starting point and said target.

25. The device of claim 16 wherein said motorized means rotates a scoring wheel and said device includes means for stopping said scoring wheel when said projectile contacts said target.

26. The device of claim 25 wherein said scoring wheel is located behind a shield, said shield contains a plurality of windows, at least one eccentric mark is provided on said scoring wheel, and said eccentric mark appears in a window when said wheel is stopped in a position that aligns said mark with said window.

27. The device of claim 26 wherein a hinge joins said game sections and said sections are foldable about said hinge to move said game sections to said closed position and rotated apart by 90 degrees around said hinge to move said game sections to an open position wherein one of said game sections forms a backdrop and said backdrop provides said shield and said scoring wheel rotates in said backdrop.

28. The device of claim 27 wherein said target is located on one end of said playing surface and said playing surface provides a path between said starting point and said target along the face of said playing surface.

29. The device of claim 28 wherein said target is located against said backdrop and a trough guides said projectile from said starting point to said target.

30. The device of claim 29 wherein said target and trough are located above said playing surface.

31. The device of claim 16 wherein said motorized means comprises a wind up spring.

* * * * *